US005888097A

United States Patent [19]

DiCicco

[11] Patent Number: 5,888,097

[45] Date of Patent: Mar. 30, 1999

[54] BACKSHELL ASSEMBLY FOR REPAIRABLE CABLE ASSEMBLY

[75] Inventor: William M. DiCicco, Hollis, N.H.

[73] Assignee: Harco Laboratories, Inc., Branford, Conn.

[21] Appl. No.: 800,260

[22] Filed: Feb. 13, 1997

[51] Int. Cl.[6] ..... H01R 9/03

[52] U.S. Cl. ..... 439/610; 439/589

[58] Field of Search ..... 439/607–610, 439/587, 589

[56] References Cited

U.S. PATENT DOCUMENTS

| | | | |
|---|---|---|---|
| 3,078,436 | 2/1963 | Berry | 439/610 |
| 3,297,979 | 1/1967 | O'Keefe et al. | 439/610 |
| 4,025,145 | 5/1977 | Shaffer et al. | 439/610 |
| 4,382,653 | 5/1983 | Blanchard | 439/610 |
| 5,099,572 | 3/1992 | Lazaro et al. | 439/589 |

*Primary Examiner*—Hien Vu

*Attorney, Agent, or Firm*—St. Onge Steward Johnston & Reens LLC

[57] ABSTRACT

There is provided a backshell assembly for a repairable cable assembly having a cable with wires and an electrical connector including an electrically conductive housing with an opening and electrical contacts mounted inside the housing, where the wires are electrically coupled to the electrical contacts. The backshell assembly includes an electrically conductive cable shield adapter engaging the cable and providing electrical shielding for the wires. Detachably engaging the cable shield adapter is an electrically conductive sleeve which also provides electrical shielding for the wires. The sleeve and the cable shield adapter are sized to telescopingly engage one another. The backshell assembly further includes an electrically conductive coupling member engaging the sleeve and detachably engaging the housing over the opening such that when the coupling member is detached from the housing, the sleeve is slidable away from the cable shield adapter to provide access to the wires and to the electrical contacts.

6 Claims, 2 Drawing Sheets

BACKSHELL ASSEMBLY FOR REPAIRABLE CABLE ASSEMBLY

FIELD OF THE INVENTION

The invention relates to a repairable cable assembly, and more specifically, to a backshell assembly for a repairable cable assembly which provides access to electrical contacts and wiring connections housed therein.

BACKGROUND OF THE INVENTION

Electrical cables are frequently connected to a connector which is engageable with and disengageable from an electrical component to which tile cable is to be connected. The connector houses electrical contacts to which wires of the cable are electrically coupled.

It is known in the art to provide assemblies for electrical cables which permit access to the electrical contacts in the connector for repair purposes, while providing electrical shielding for the wires of the cable. In addition to providing ease of access, these cable assembles must be flexible, moisture resistant, capable of resisting vibration, operable over a wide temperature range, and shielded from electromagnetic interference (EMI) and radio frequency interference (RFI).

U.S. Pat. No. 5,380,224 ("the '224 patent") discloses one type of prior art repairable cable assembly. The cable assembly of the '224 patent includes a corrugated metal tubing backshell secured at one end to a stiff cable sleeve and secured at the other end to a coupling assembly detachable from a connector. The corrugated backshell is axially compressible along wiring extending from the cable sleeve to the connector to provide access to the wiring and electrical contacts housed in the connector.

The primary disadvantage of the cable assembly of the '224 patent is the space required by the axially compressible corrugated metal backshell. Even by its admission, the '224 patent states that axial compression of the corrugated metal backshell against the stiff cable sleeve following detachment of the coupling assembly from the connector provides enough room for repair only if the corrugated metal backshell is "at least 1.5 inches (38.1 mm) in the expanded condition" (col. 6, lines 7–10). Often times, especially in machine environments with severe space restrictions, it is difficult to ensure at least 1.5 inches of space for a corrugated metal backshell to occupy. Therefore, the cable assembly of the '224 patent has restricted applicability.

Other types of prior art repairable cable assemblies include open bundle designs, conduit or raceway designs, braid socks and shrink sleeve boot designs. These designs and their corresponding disadvantages are fully discussed in the Background of the Invention section of the '224 patent which is incorporated by reference herein and thus, they will not be discussed any further.

What is desired, therefore, is a backshell assembly for a repairable cable assembly which provides room for inspecting and repairing or replacing electrical contacts and wiring connections without specific space requirements, while providing ease of access, flexibility, moisture resistance, vibration resistance, wide operable temperature range, and shielding from EMI and RFI.

SUMMARY OF THE INVENTION

Accordingly, it is an object of the invention to provide a backshell assembly for a repairable cable assembly which provides room for inspecting and repairing or replacing electrical contacts and wiring connections without specific space requirements.

A further object of the invention is to provide a backshell assembly for a repairable cable assembly which provides access for inspection of electrical contacts and wiring connections without use of any tools.

Yet another object of the invention is to provide a backshell assembly for a repairable cable assembly which makes inspection and repair or replacement of electrical contacts and wiring connections more cost effective.

Another object of the invention is to provide a backshell assembly for a repairable cable assembly which provides moisture resistance.

These and other objects of the invention are achieved by a backshell assembly for a repairable cable assembly having a cable with wires and an electrical connector including an electrically conductive housing with an opening and electrical contacts mounted inside the housing, where the wires are electrically coupled to the electrical contacts. The backshell assembly includes an electrically conductive cable shield adapter engaging the cable and providing electrical shielding for the wires. Detachably engaging the cable shield adapter is an electrically conductive sleeve which also provides electrical shielding for the wires. The sleeve and the cable shield adapter are sized to telescopingly engage one another. The backshell assembly further includes an electrically conductive coupling member engaging the sleeve and detachably engaging the housing over the opening such that when the coupling member is detached from the housing, the sleeve is slidable away from the cable shield adapter to provide access to the wires and to the electrical contacts.

The invention and its particular features and advantages will become more apparent from the following detailed description considered with reference to the accompanying drawings.

DETAILED DESCRIPTION OF THE INVENTION

Figure 1:
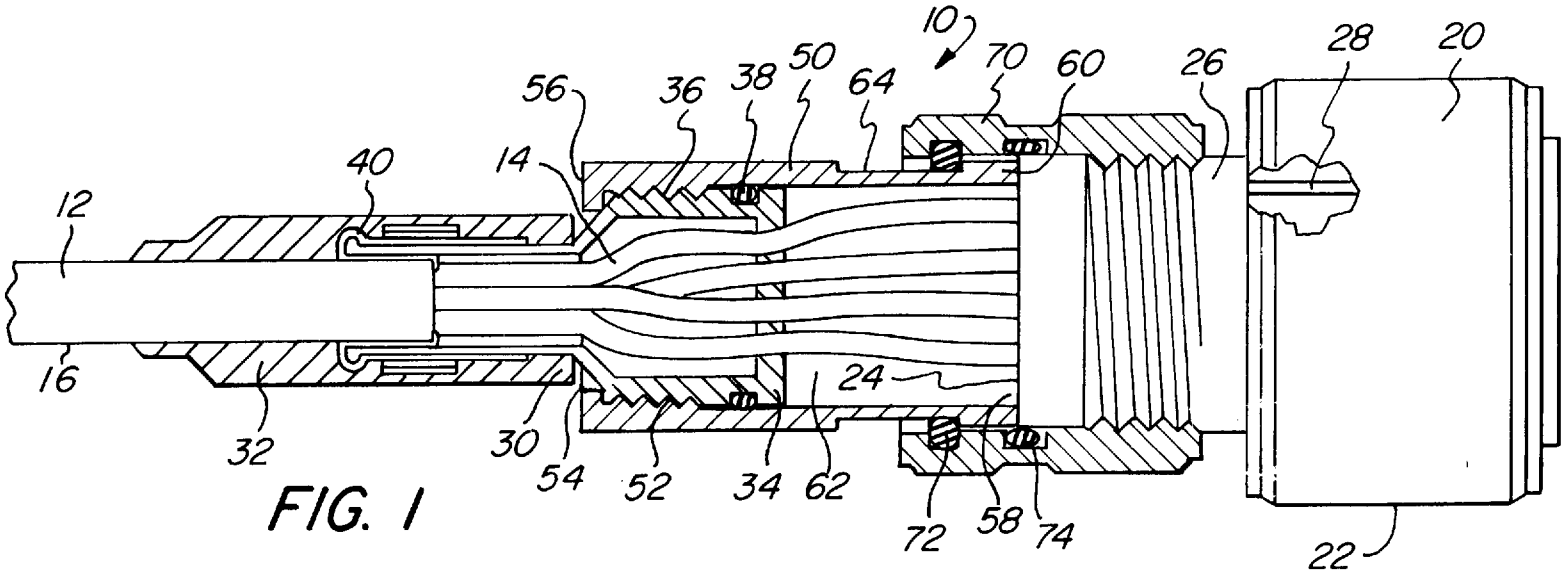
FIG. 1 is a side view of a repairable cable assembly of the present invention in an assembled position, with a backshell assembly shown in cross section.

FIG. 1 is a side view of a repairable cable assembly 10 of the present invention in an assembled position. The repairable cable assembly 10 includes a cable 12 having a plurality of electrical wires 14 encased in a protective cover 16 and an electrical connector 20 having an electrically conductive housing 22 with an opening 24 defined by a threaded collar 26. The protective cover 16 provides shielding from electromagnetic interference (EMI) and radio frequency interference (RFI).

Mounted within the housing 22 are electrical contacts 28 which are accessible through the opening 24. The electrical wires 14 of the cable 12 are electrically coupled to the electrical contacts 28, typically by crimping or soldering. The cable 12 and the connector 20 are conventional; thus, any other known cable type and connector type can be used in the repairable cable assembly of the present invention.

Attached to the cable 12 is a cable shield adapter 30 with the wires 14 extending therethrough. The cable shield adapter 30 includes a first section 32 having a first preselected maximum diameter and a second section 34 having a second preselected maximum diameter. About a portion of the second section 34, there is a set of male threads 36 along with an O-ring 38. The O-ring 38 can be made from rubber or an elastomer.

Figure 2:
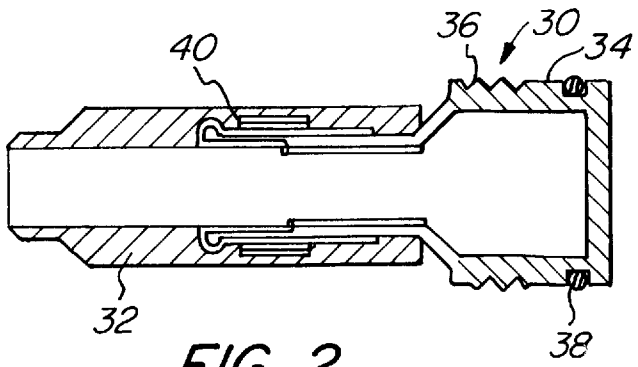
FIG. 2 is a cross-sectional side view of a cable shield adapter of the backshell assembly of FIG. 1.

The cable shield adapter 30 is attached to the cable 12 by any number of known methods, such as brazing, welding, clamping, and magnetic pulse forming (FIG. 1 shows a clamp 40 for illustrative purposes). The cable shield adapter 30, which can be made of metal (such as stainless steel), provides shielding from EMI and RFI for the electrical wires 14. FIG. 2 shows a cross-sectional side view of the cable shield adapter 30.

A sleeve 50 detachably engages the cable shield adapter 30 by mating of a set of female threads 52 about a portion of the sleeve 50 with the set of male threads 36. The sleeve 50, which can be made of metal, provides shielding from EMI and RFI for the wires 14 of the cable 12 extending therethrough. The sleeve 50 has a first aperture 54 on an end 56 facing the cable 12 and a second aperture 58 on an end 60 facing the connector 20. The first aperture 54 has a diameter greater than the first preselected maximum diameter of first section 32 but less than the second preselected maximum diameter of the second section 34. The second aperture 58 has a diameter greater than the second preselected maximum diameter of the second section 34 to allow the sleeve 50 to detachably slide away from the cable shield adapter 30. This will be described hereinbelow.

Figure 3:
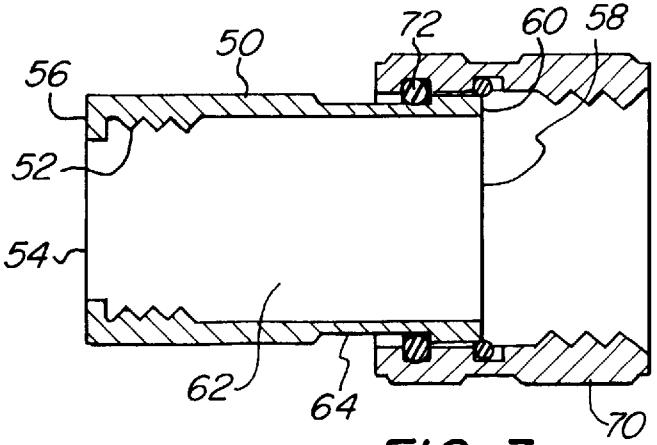
FIG. 3 is a cross-sectional side view of a sleeve of the backshell assembly of FIG. 1.

As shown in FIG. 1, when the repairable cable assembly 10 is in the assembled position, the cable shield adapter 30 telescopingly engages the sleeve 50 with the second section 34 of the cable shield adapter 30 inside the space 62 defined by the sleeve 50 and the first section 32 outside the space 62. The O-ring 38 serves to provide a seal along an inner surface diameter of the sleeve 50 to prevent entrance of moisture to which cable assemblies may be exposed. See FIG. 3 for a cross-sectional side view of the sleeve 50.

Secured to the end 60 facing the connector 20 is preferably an electrically conductive coupling member 70 which detachably engages connector 20 by threading onto the threaded collar 26 of the connector 20. The coupling member 70, which is preferably made of metal, is secured to the end 60 of the sleeve 50 by use of a retaining ring 72 of the coupling member 70 positioned in an annular retaining groove 64 on the sleeve 50. An O-ring 74 about an inner surface diameter of the coupling member 70 sealingly engages the threaded collar 26 of the connector 20 to prevent moisture from entering. In the present application, the term "backshell assembly" will refer to an assembly including the cable shield adapter 30, the sleeve 50 and the coupling member 70.

Figure 4:
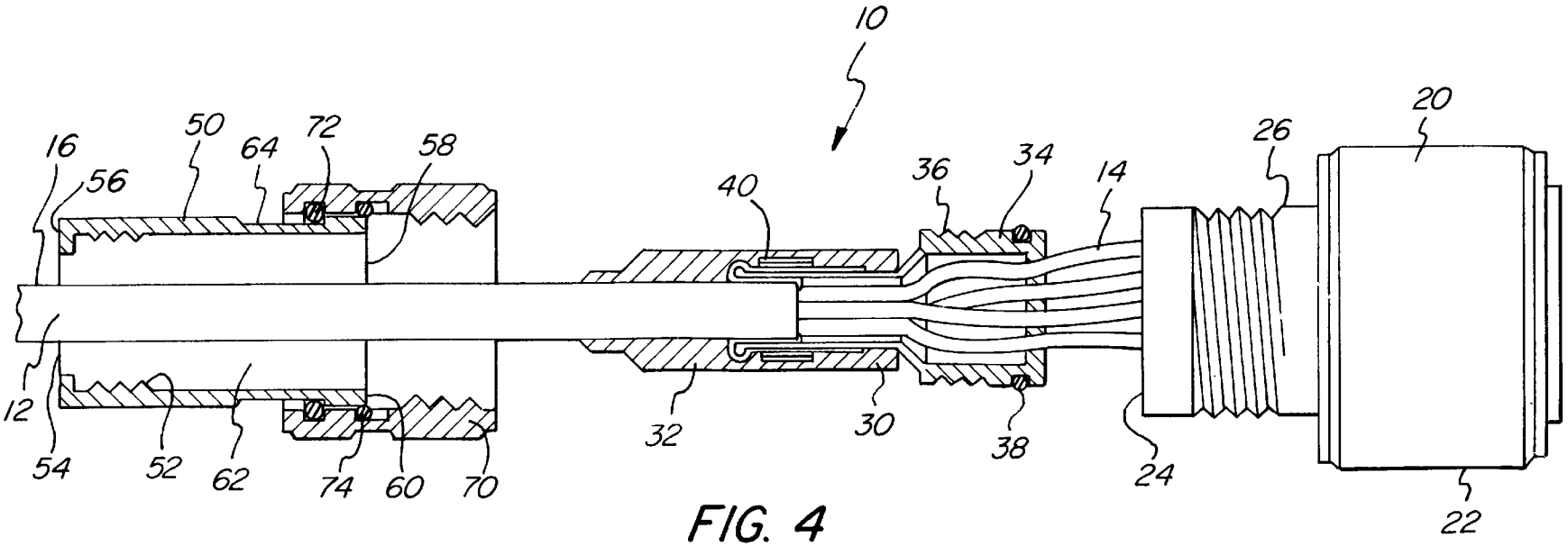
FIG. 4 is a side view of the repairable cable assembly of FIG. 1 with the sleeve of the backshell assembly detached from the cable shield adapter.

When it becomes necessary to inspect, and repair or replace the electrical contacts 28 and/or the connections of the wires 14 to the contacts 28, the coupling member 70 is unthreaded from the threaded collar 26 of the connector 20. Given the length of the retaining groove 64, the coupling member 70 can be unthreaded and backed off the threaded collar 26 without placing stress on the wires 14. After the coupling member 70 is detached from the connector 20, the sleeve 50 is unthreaded from the cable shield adapter 30 and slid in a direction away from the connector 20. As shown in FIG. 4, the sleeve 50 can be completely detached from the cable shield adapter 30 and slid over the cable 12 along with coupling member 70 so as to provide full access to the opening 24 of the connector 20.

Throughout the entire inspect and repair or replace operation, there is never a need to remove the cable shield adapter 30 from the cable 12; thus, the original shielding effectiveness can be maintained. Furthermore, because no tools are needed to provide access to the opening 24 of the connector 20, inspection and repair or replacement operations are expedited and made more cost effective.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A backshell assembly for a repairable cable assembly having a cable comprising wires and an electrical connector including an electrically conductive housing with an opening and electrical contacts mounted inside said housing, said wires electrically coupled to said electrical contacts, which comprises:

an electrically conductive cable shield adapter having an outer wall and an inner wall, said inner wall engaging said cable and providing electrical shielding for said wires;

an electrically conductive sleeve detachably engaging on said outer wall of said cable shield adapter and providing electrical shielding for said wires, said sleeve and said cable shield adapter sized to telescopingly engage one another; and an electrically conductive coupling member engaging on an outer portion of said sleeve by a retaining ring, said coupling member engaging said housing over said opening in a connecting direction such that when said coupling member detached from said housing, said sleeve and said coupling member are slidable away from said cable shield adapter in an opposite direction of said connecting direction to provide access to said wires and to said electrical contacts; and wherein said cable shield adapter comprising a first section having a first preselected maximum diameter, a second section having a second preselected maximum diameter, and a first set of threads; and said sleeve having an aperture with a diameter greater than said first preselected maximum diameter but less than said second preselected maximum diameter for receiving said cable shield adapter in a telescopingly manner, said sleeve having a second set of threads corresponding to said first set of threads for detachably engaging said cable shield adapter.

2. The backshell assembly of claim 1, wherein said cable shield adapter further includes an O-ring to provide a seal along an inner surface diameter of said sleeve when said sleeve engages said cable shield adapter.

3. The backshell assembly of claim 1, wherein said sleeve further includes a second aperture with a diameter greater than said second preselected maximum diameter for allowing said sleeve to be slidable away from said cable shield adapter when said sleeve is detached from said cable shield adapter.

4. A repairable cable assembly, which comprises:

an electrical connector including an electrically conductive housing with an opening and electrical contacts mounted inside said housing, said electrical contacts accessible through said opening;

a cable comprising wires;

a backshell assembly comprising:

an electrically conductive cable shield adapter having an outer wall and an inner wall, said inner wall engaging said cable with said wires extending therethrough, said cable shield adapter providing electrical shielding for said wires;

an electrically conductive sleeve detachably engaging on said outer wall of said cable shield adapter with said wires extending therethrough to provide electrical shielding for said wires;

an electrically conductive coupling member engaging on an outer portion of said sleeve by a retaining ring with said wires extending therethrough, said coupling member engaging said housing over said opening in a connecting direction so that said wires are coupled to said electrical contacts; and said sleeve and said cable shield adapter sized to telescopingly engage one another so that when detached, said sleeve and said coupling member are slidable away from said cable shield adapter in an opposite direction of said connecting direction to provide access to said wires and to said electrical contacts; and wherein said cable shield adapter comprising a first section having a first preselected maximum diameter, a second section having a second preselected maximum diameter, and a first set of threads; and said sleeve having an aperture with a diameter greater than said first preselected maximum diameter but less than said second preselected maximum diameter for receiving said cable shield adapter in a telescopingly manner said sleeve having a second set of threads corresponding to said first set of threads for detachably engaging said cable shield adapter.

5. The repairable cable assembly of claim 4, wherein said cable shield adapter further includes an O-ring to provide a seal along an inner surface diameter of said sleeve when said sleeve engages said cable shield adapter.

6. The repairable cable assembly of claim 4, wherein said sleeve further includes a second aperture with a diameter greater than said second preselected maximum diameter for allowing said sleeve to be slidable away from said cable shield adapter when said sleeve is detached from said cable shield adapter.

* * * * *